US012163391B2

(12) United States Patent
Provost

(10) Patent No.: US 12,163,391 B2
(45) Date of Patent: Dec. 10, 2024

(54) MODULAR ACTUATOR, METHOD, AND SYSTEM

(71) Applicant: Baker Hughes Oilfield Operations LLC, Houston, TX (US)

(72) Inventor: Wilfred Provost, Tomball, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 59 days.

(21) Appl. No.: 18/186,604

(22) Filed: Mar. 20, 2023

(65) Prior Publication Data

US 2024/0318519 A1 Sep. 26, 2024

(51) Int. Cl.
*E21B 23/04* (2006.01)

(52) U.S. Cl.
CPC ..... *E21B 23/0421* (2020.05)

(58) Field of Classification Search
CPC ..... E21B 23/0421
See application file for complete search history.

(56) References Cited

U.S. PATENT DOCUMENTS 3,085,530 A * 4/1963 Williamson ..... B30B 15/16 72/453.13
3,820,346 A * 6/1974 Wisotsky ..... E02D 7/28 181/119
6,250,388 B1 * 6/2001 Carmi ..... E21B 43/25 166/63
7,635,029 B2 12/2009 MacDougall et al.
8,118,105 B2 2/2012 Wright et al.
8,726,644 B2 5/2014 Nellessen
8,857,175 B2 10/2014 Geiger
9,228,423 B2 1/2016 Powell et al.
9,482,359 B2 11/2016 Borchgrevink et al.
9,488,199 B2 11/2016 Nellessen
(Continued)

FOREIGN PATENT DOCUMENTS

AU 2021228648 A1 9/2021
CN 101341005 A 1/2009
(Continued)

OTHER PUBLICATIONS

Notification of Transmittal of the International Search Report and the Written Opinion of the International Searching Authority, or the Declaration; PCT/UC2024/018989; Mail date: Jul. 8, 2024; 8 pages.

*Primary Examiner* — Shane Bomar
(74) *Attorney, Agent, or Firm* — Baker Hughes Patent Organization

(57) ABSTRACT

An actuator including an impulse generation arrangement including an atmospheric pressure chamber, and a valve connected fluidly to the chamber, a prime mover arrangement including a device piston, and a hydrostatic pressure source, and a hydraulic chamber disposed between and fluidically connecting the impulse generation arrangement and the prime mover arrangement. A method for actuating a downhole tool including signaling the trigger in an actuator, opening the atmospheric chamber of the actuator, causing a low pressure pulse in the actuator, and moving the device piston with the pulse. A borehole system including a borehole in a subsurface formation, a string in the borehole, and the actuator disposed within or as a part of the string.

23 Claims, 7 Drawing Sheets

(56) References Cited

U.S. PATENT DOCUMENTS

| | | | | |
|---|---|---|---|---|
| 9,664,004 | B2 | 5/2017 | Martinez et al. | |
| 10,337,277 | B2 | 7/2019 | Van Wijk et al. | |
| 10,371,280 | B2 | 8/2019 | Magnus | |
| 10,745,998 | B2 | 8/2020 | Prost et al. | |
| 10,900,307 | B2 | 1/2021 | Al Hussin et al. | |
| 10,982,743 | B2 | 4/2021 | Kapoor et al. | |
| 11,085,466 | B2 | 8/2021 | Orth et al. | |
| 11,091,971 | B2 | 8/2021 | Oser et al. | |
| 11,274,526 | B2 | 3/2022 | Deville et al. | |
| 11,313,203 | B2 | 4/2022 | Walton et al. | |
| 11,448,243 | B2 | 9/2022 | Orth et al. | |
| 2005/0016924 | A1* | 1/2005 | DeVoe | F03G 7/005 210/644 |
| 2008/0078553 | A1* | 4/2008 | George | E21B 34/08 166/332.8 |
| 2013/0292110 | A1 | 11/2013 | Fraser et al. | |
| 2015/0176368 | A1* | 6/2015 | Martin | E21B 34/045 137/71 |
| 2016/0130896 | A1* | 5/2016 | Halfmann | E21B 23/06 166/208 |
| 2017/0370183 | A1 | 12/2017 | Stolboushkin et al. | |
| 2020/0157917 | A1* | 5/2020 | Olguin | E21B 23/006 |
| 2020/0332613 | A1 | 10/2020 | Al Hussin | |
| 2022/0235627 | A1 | 7/2022 | Minassa et al. | |
| 2022/0341283 | A1* | 10/2022 | Jacob | E21B 23/08 |

FOREIGN PATENT DOCUMENTS

| | | | |
|---|---|---|---|
| CN | 114059918 | A | 2/2022 |
| EP | 2276908 | B1 | 1/2012 |
| EP | 2630332 | B1 | 3/2018 |
| NO | 333313 | B1 | 4/2013 |
| WO | 2022082319 | A1 | 4/2022 |
| WO | 2022148668 | A1 | 7/2022 |

* cited by examiner

MODULAR ACTUATOR, METHOD, AND SYSTEM

BACKGROUND

In the resource recovery and fluid sequestration industries, there are many different types of tools that are in need of actuation. The tools are different in purpose, construction, material properties, and dimensions. Traditionally an actuator is made a part of the tool since actuators rely upon mechanical transfer of energy to effect the actuation. Included actuators are engineered and designed to fit and manage the various dimensions of parts and properties of those parts. As such, the actuators work well but remain unique for each tool. There is little ability to standardize components where unique characteristics of tools must be addressed individually. The art is always in search of efficiency enhancements and hence would welcome innovations supporting standardizations in the industry.

SUMMARY

An embodiment of an actuator including an impulse generation arrangement including an atmospheric pressure chamber, and a valve connected fluidly to the chamber, a prime mover arrangement including a device piston, and a hydrostatic pressure source, and a hydraulic chamber disposed between and fluidically connecting the impulse generation arrangement and the prime mover arrangement.

An embodiment of a method for actuating a downhole tool including signaling the trigger in an actuator, opening the atmospheric chamber of the actuator, causing a low pressure pulse in the actuator, and moving the device piston with the pulse.

An embodiment of a borehole system including a borehole in a subsurface formation, a string in the borehole, and the actuator disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
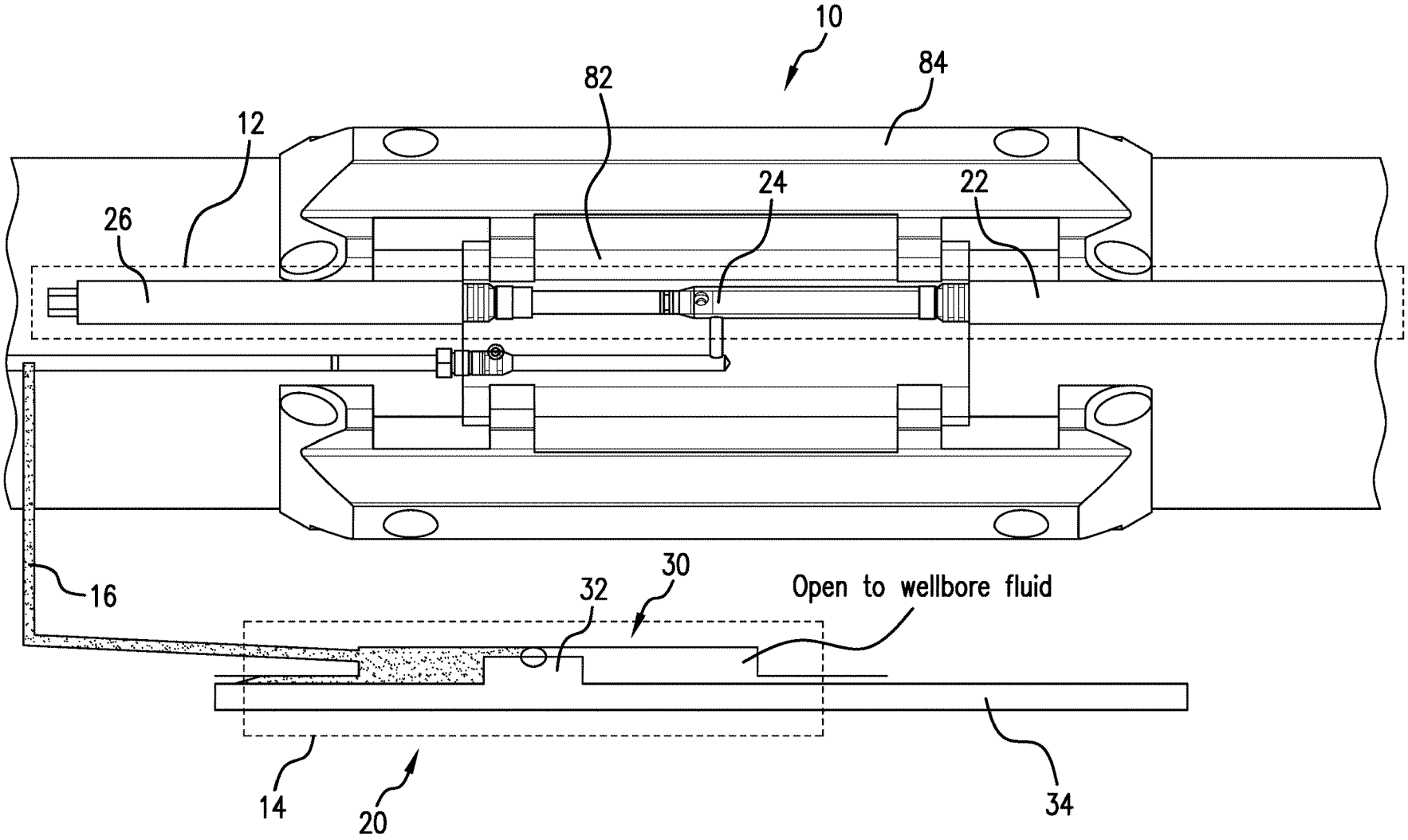
FIG. 1 is a view of a first embodiment of an actuator that may be configured to be modular.
Figure 2:
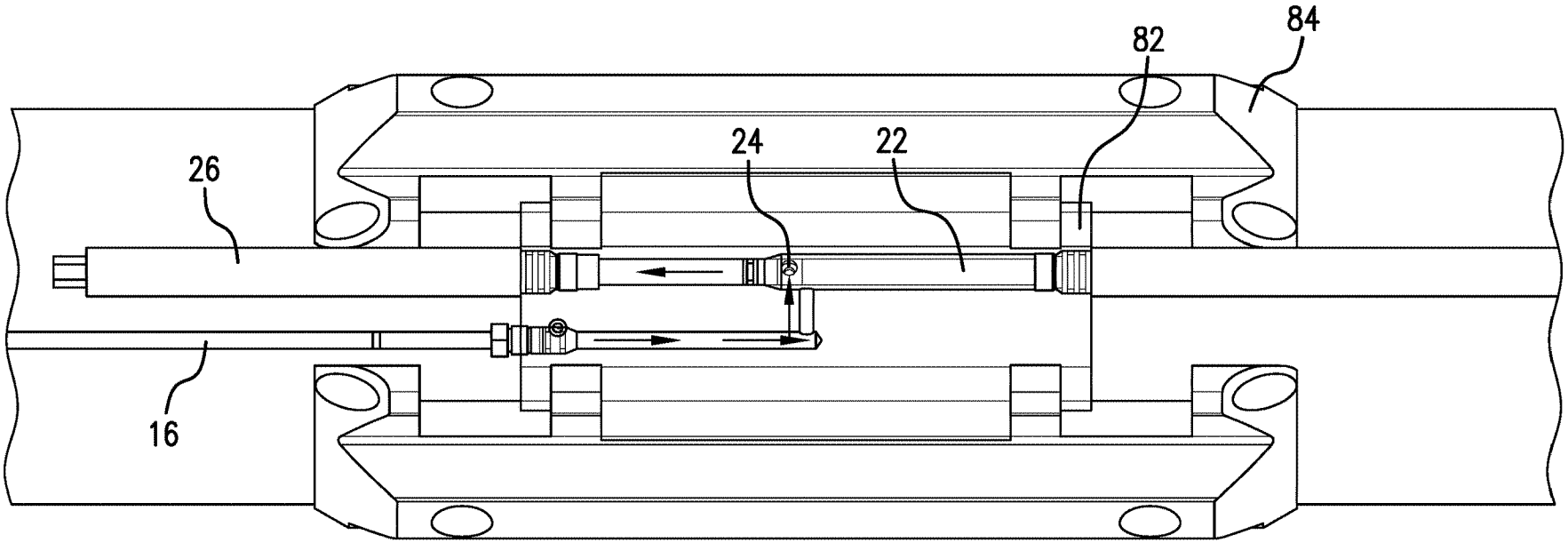
FIG. 2 is the actuator of FIG. 1 showing a flow path with arrows.

Referring to FIG. 1, a first embodiment of an actuator 10 is illustrated. Actuator 10 includes an impulse generation arrangement 12 (one or more components that together create a positive or negative pressure pulse usable to do work), a prime mover arrangement 14, and a hydraulic chamber 16 between the impulse generation arrangement 12 and the prime mover arrangement 14. In embodiments, the hydraulic chamber 16 directly connects arrangement 12 and 14 and in some embodiments, exclusively connects arrangements 12 and 14. In some embodiments, the chamber 16 is configured as a control line though other structures capable of fluidically joining the arrangement 12 and 14 may be contemplated. Each of these conditions may also exist in a single embodiment as is illustrated in FIG. 1. The FIG. 1 embodiment functions in a negative pressure paradigm to shift a tool or device 20 on demand and pursuant to a signal being received by the actuator 10. The signal may be generated at surface or other remote location or may be generated in the actuator 10 pursuant to a timer, or sensor configured to sense temperature or pressure or other borehole parameter. In embodiments, the signal may be electrical, electromagnetic, acoustic, optic, etc. and is received ultimately at a trigger 22 (of a type known to the industry) that controls a valve 24 fluidly connected to an atmospheric or lower pressure than expected hydrostatic pressure chamber 26. For efficiency, the term "atmospheric chamber" will be used hereinafter, including in the claims appended hereto, and is intended to mean both a chamber at literal atmospheric pressure (14.7 pounds per square inch) and other pressures lower than anticipated hydrostatic pressure at the intended target location for use of the actuator 10. In FIG. 1, the hydraulic chamber 16 can be seen to connect to the prime mover 14, which may be a part of the device to be actuated or may be a configuration to move another device. In any event the prime mover as illustrated in FIG. 1 includes a piston chamber 30 having a piston 32 therein that bifurcates the chamber 30. One end of the chamber 30 is connected to the hydraulic chamber 16 while the other end of the chamber 30 is connected to hydrostatic pressure, or simply open to hydrostatic pressure. Upon actuation of the actuator 10, meaning that a signal has been received at trigger 22 and the valve 24 has been opened, fluid from the hydraulic chamber 16 will be drawn into the atmospheric chamber 26 thereby creating a negative pressure pulse in the hydraulic chamber 16 as hydraulic fluid flows into the atmospheric chamber 26 (see arrows on FIG. 2). Because of the negative pressure in the chamber 16, the hydrostatic pressure at the chamber 30 will cause the piston 32 to move toward hydraulic chamber 16 and thereby shift the physical position of the piston 32. With the physical position shift, the device 20 will be either directly or indirectly actuated. In the case of the illustration of FIG. 1, the piston 32 is a part of a sliding sleeve 34 and hence is part of a directly actuated device 20.

Figure 3:
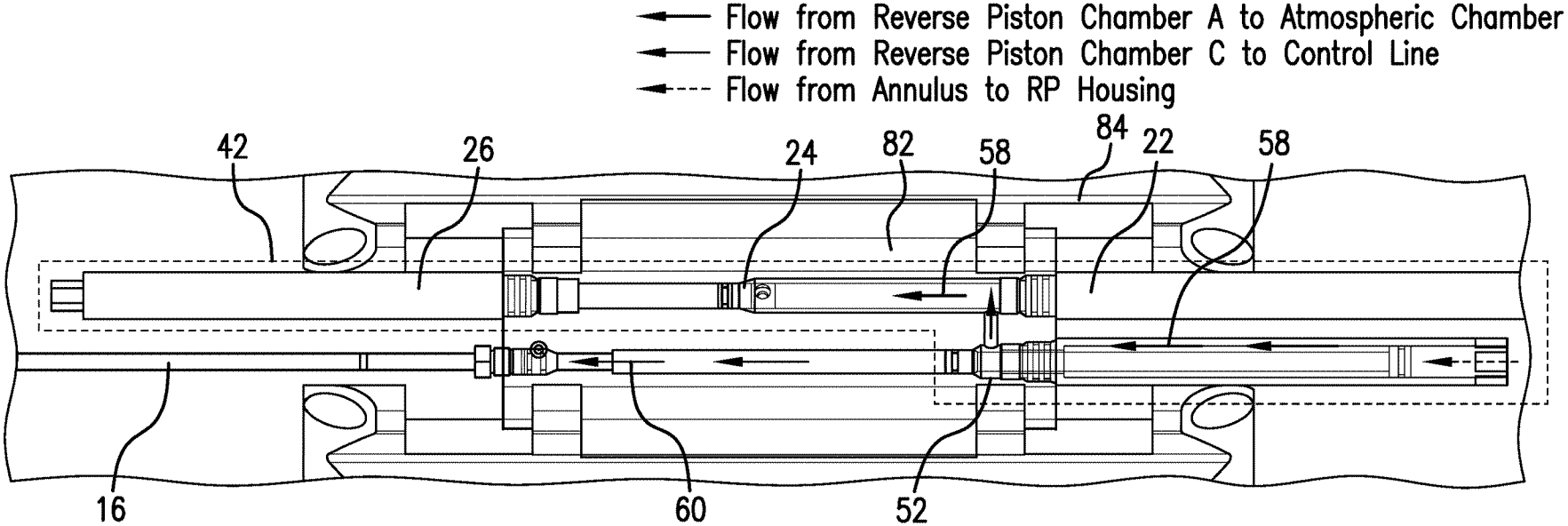
FIG. 3 is a second embodiment of an actuator that may be configured to be modular.
Figure 4:
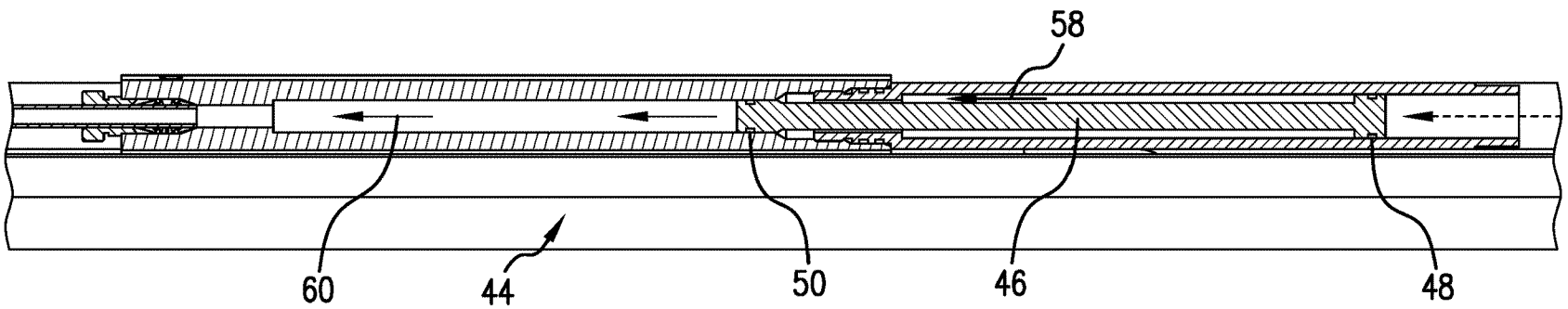
FIG. 4 is an enlarged view of a portion of FIG. 3.

Referring to FIGS. 3 and 4, a second embodiment of an actuator 40 is illustrated. The second embodiment actuates the prime mover 14 with positive pressure rather than the negative pressure the embodiment of FIG. 1 uses. Where components are substantially similar to FIG. 1, those components will bear the same reference numerals. The impulse generation arrangement 42 is in part similar to the previous embodiment but arrangement 42 also includes a reverse piston augmenter 44. The augmenter 44 comprises a reverse piston 46 having a larger seal area 48 at an end thereof that is exposed to hydrostatic pressure and a smaller seal area 50 at an end thereof that is connected to the hydraulic chamber 16. The differences in seal areas between 48 and 50 will cause the pressure applied to the piston 46 to be magnified at smaller seal area 50. This increase in the pressure over hydrostatic pressure may be harnessed for use in a positive pressure actuation that is initially instigated by the same trigger and atmospheric chamber as in FIG. 1. It will be appreciated that seal 50 is beyond a fluid intersection 52 with the valve 24 so that the fluid getting pulled into the atmospheric chamber 26 is fluid that is initially disposed about the piston 46 and between seal 48 and intersection 52 rather than fluid that is in the hydraulic chamber 16. Hence, the negative pulse that pulls the piston in toward the atmospheric chamber 26 (see arrows 58) does not create a negative pressure in hydraulic chamber 16 but rather only causes an increase in the pressure in hydraulic chamber 16 equal to the hydrostatic pressure plus the additional force that is created by the negative pressure in atmospheric chamber 26 pulling on the piston 46. The pressure applied to the prime mover 14 is illustrated with arrows 60.

Figure 5:
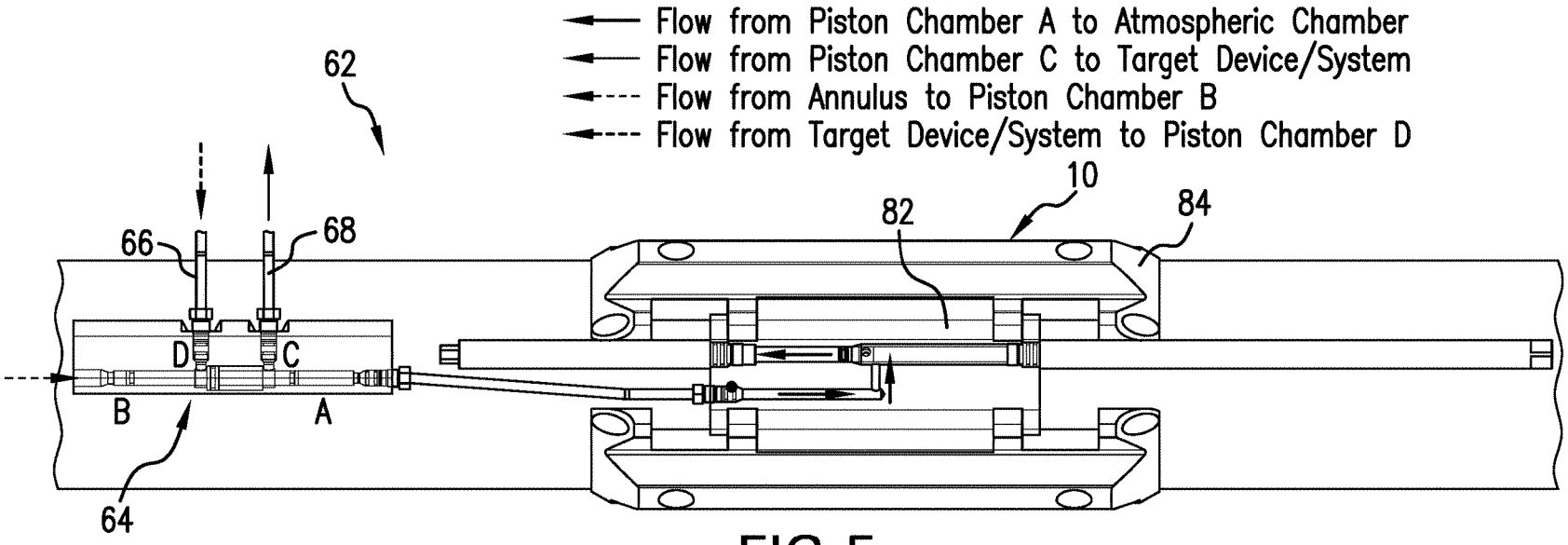
FIG. 5 is a third embodiment of an actuator that may be configured to be modular.
Figure 6:
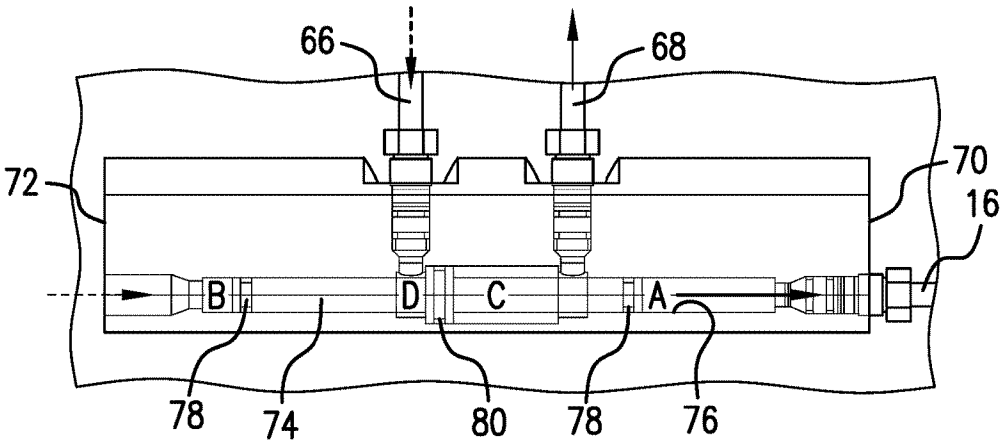
FIG. 6 is an enlarged view of a portion FIG. 5.

Referring now to FIGS. 5 and 6, a third embodiment of actuator 62 is illustrated. This embodiment is for the impulse generation arrangement 12 and the hydraulic chamber 16, identical to FIG. 1 but the actuator 62 adds a loop sub 64 that also manages vent fluid from the prime mover arrangement 14. Loop sub 64 is disposed between the hydraulic chamber 16 and hydrostatic pressure but also is configured to operate a closed loop of hydraulic fluid that is connected to the prime mover arrangement 14. Specifically, line 66 is connected to one end of the prime mover arrangement 14 (as illustrated in FIG. 1, for example) and line 68 is connected to the other end of arrangement 14 (for example, line 66 may be connected to where chamber 16 is connected in FIG. 1, while line 68 would be connected where the arrangement 14 is open to hydrostatic pressure in FIG. 1. The reverse is also possible.) Accordingly, pressure in line 66 will push the piston 32 toward line 68 and pressure in line 68 will push piston 32 toward line 66. Returning to the loop sub 64 in FIG. 6, it will be appreciated that the hydraulic chamber 16 is connected at one end 70 of the loop sub and hydrostatic pressure is available at the other end 72. A piston 74 is disposed in a chamber 76 and sealed to the chamber at seals 78, having the same seal diameter. The piston 74 is also sealed at seal 80 between the lines 66 and 68. Accordingly, upon the triggering of trigger 22 and opening of valve 24, a negative pressure is applied to the hydraulic chamber 16, which causes the piston 74 to move under the auspices of the hydrostatic pressure at end 72 to the right of the figure thereby pressuring the fluid in line 68. This may open or may close an actuated device depending upon where the pressured fluid is connected thereto. Actuation fluid is conserved by moving from an opposite side of the prime mover 14 back into the loop sub 64 at line 66. Accordingly, actuation fluid need not be vented.

Referring back to FIGS. 1, 2, 3, and 5, it will be appreciated that each figure illustrates a housing 82 and a housing coupling 84. This is an additional benefit of the disclosure hereof. While the configuration of the impulse generation arrangement prime mover arrangement and hydraulic chamber may be used in a tool in a dedicated manner, the elements of FIGS. 1, 2, 3, and 5 may also be configured with the housing 82 and housing coupling 84 to be modular. The housings 82 are universal and the housing couplings 84 are sized for many different diameter tools and even differently shaped tools destined for use in the borehole. The housing coupling 84 and housing 82 work together to attach the actuator to the ultimate tool. This means that one of the significant drawbacks of the prior art actuators being specific and unique to the tools they actuate, the actuators according to this disclosure may be modular in nature and therefore one actuator may be used for a number of different tools thereby reducing the number of different actuators that must be provisioned. Further, this disclosure allows for a number of actuators in modular form to be used on a single tool for multiple actuations, if desired.

Figure 7:
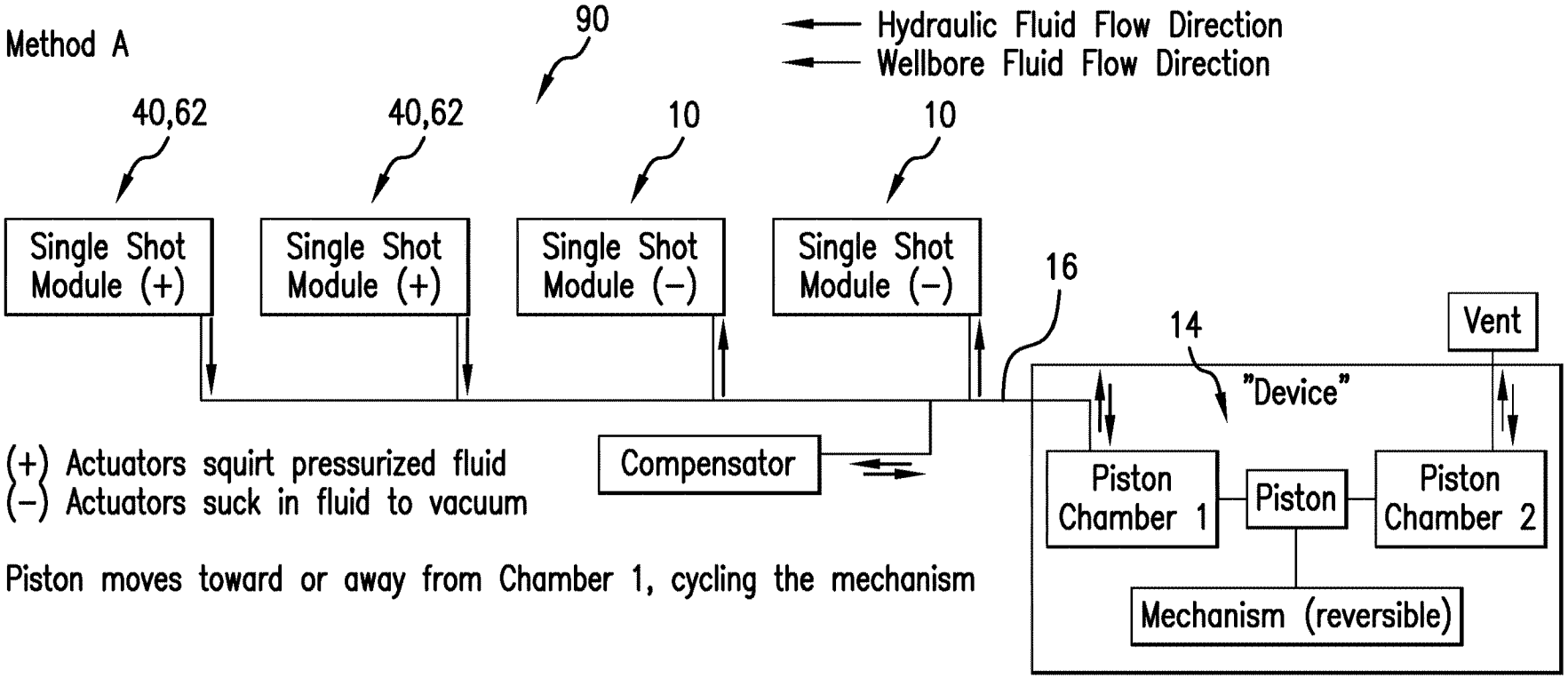
FIG. 7 is a system diagram employing a plurality of the actuators disclosed herein.

Referring to FIG. 7, a system 90 is illustrated that employs a number of the actuators 10, 40 or 62 disclosed herein. As illustrated, there are two positive pressure actuators 40 or 62 and two negative pressure actuators 10. There could be more or fewer of each and there could be all negative or all positive actuators. In each case, an actuator will act once to take the actions described above and therefore move the end device in one way or the other. Additional actuations may be provided by each one of the additional actuators. The number of actuators is limited only by available space. Additionally, and optionally, a compensator with a restricted orifice may be disposed in fluid communication with the hydraulic chamber 16 to allow the pressure in the chamber 16 to equalize over time. The actuation would take seconds while the compensator would bleed for hours and so the situation of permanent pressure differential between hydrostatic and the hydraulic chamber 16 can be avoided while having no impact on actuation of the tool.

Figure 8:
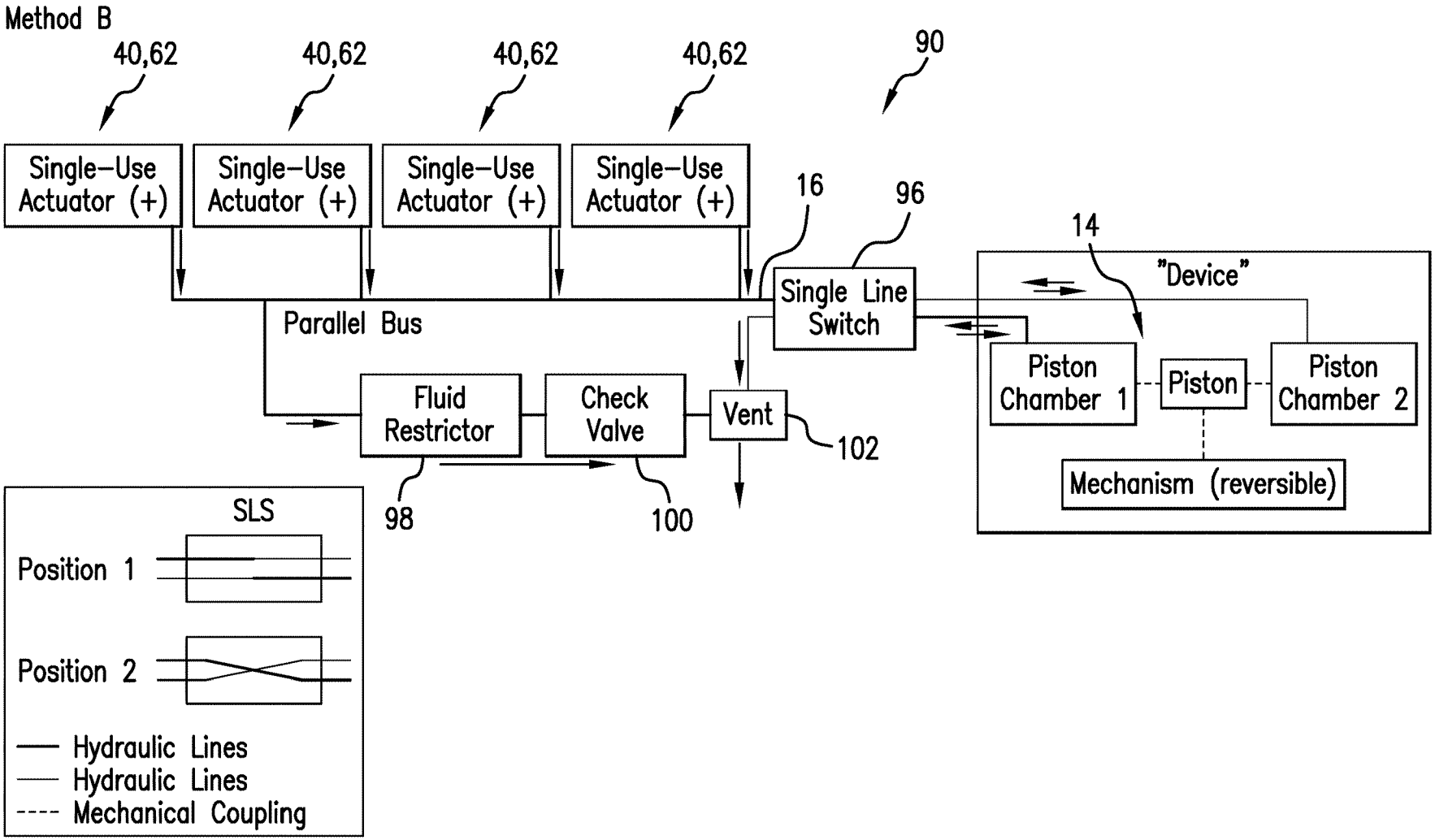
FIG. 8 is a system diagram of another embodiment employing a plurality of the actuators disclosed herein.

Referring to FIG. 8, a similar system 90 is illustrated where reversible movement of the ultimate tool is accomplished with all positive actuators but where a single line switch 96 is incorporated between the hydraulic chamber 16 and the prime mover arrangement 14. A single line switch is a commercially available product and hence requires no specific discussion. This system will include a fluid restrictor 98, a check valve 100 and a vent 102 to exhaust all excess fluid to the annulus.

Each one of the components (atmospheric chamber 26, trigger 22, augmenter 44, loop sub 64, etc.) of the actuators 10, 40 and 62 is itself modular and can be replaced to change overall action in the system. For example, different seal areas can be used in components to adjust the volume or pressure of fluid moved thereby. The trigger 22 may be configured to respond to whatever trigger an operator might dictate and still be threadable into the housing 82.

Figure 9:
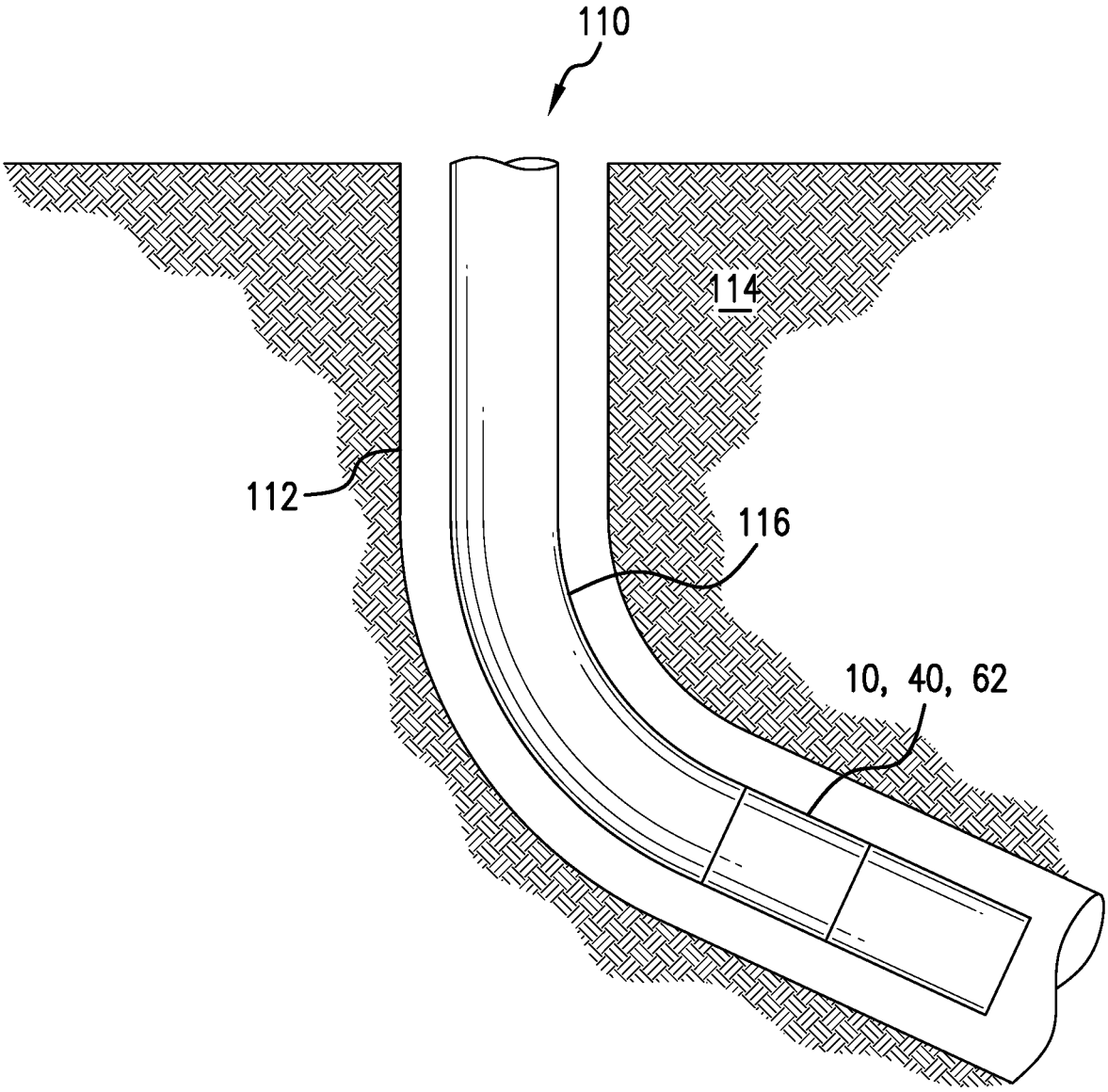
FIG. 9 is a view of a borehole system including an actuator as disclosed herein.

Referring to FIG. 9, a borehole system 110 is illustrated. The system 110 comprises a borehole 112 in a subsurface formation 114. A string 116 is disposed within the borehole 112. An actuator 10, 40, 62 as disclosed herein is disposed within or as a part of the string 116.

Set forth below are some embodiments of the foregoing disclosure:

Embodiment 1: An actuator including an impulse generation arrangement including an atmospheric pressure chamber, and a valve connected fluidly to the chamber, a prime mover arrangement including a device piston, and a hydrostatic pressure source, and a hydraulic chamber disposed between and fluidically connecting the impulse generation arrangement and the prime mover arrangement.

Embodiment 2: The actuator as in any prior embodiment, wherein the hydraulic chamber directly connects the impulse generation arrangement with the prime mover arrangement.

Embodiment 3: The actuator as in any prior embodiment, wherein the hydraulic chamber exclusively connects the impulse generation arrangement with the prime mover arrangement.

Embodiment 4: The actuator as in any prior embodiment, wherein the hydraulic chamber is a control line.

Embodiment 5: The actuator as in any prior embodiment, wherein the actuator is a modular construction assemblable with a plurality of distinct and different tools.

Embodiment 6: The actuator as in any prior embodiment, further comprising a housing coupler configured to attach the actuator to a tool to be actuated.

Embodiment 7: The actuator as in any prior embodiment, wherein the impulse generation arrangement is disposed in a housing that is configured to attach to the housing coupler.

Embodiment 8: The actuator as in any prior embodiment, further including a reverse piston augmenter disposed between the hydrostatic pressure source and the device piston.

Embodiment 9: The actuator as in any prior embodiment, wherein the reverse piston augmenter includes a reverse piston having pressure areas that cause the reverse piston to increase the pressure of hydraulic fluid contacting the device piston above a pressure of the hydrostatic pressure acting on the reverse piston.

Embodiment 10: The actuator as in any prior embodiment, further including a hydraulic loop sub disposed between the hydrostatic pressure source and the device piston.

Embodiment 11: The actuator as in any prior embodiment, wherein the loop sub includes a hydraulic piston that includes piston areas causing hydraulic fluid pressure to be shuttled between lines.

Embodiment 12: The actuator as in any prior embodiment wherein the hydraulic loop sub comprises a hydrostatic pressure inlet, a trigger outlet, a device fluid vent inlet and a device fluid outlet.

Embodiment 13: The actuator as in any prior embodiment, further including a compensator arrangement.

Embodiment 14: The actuator as in any prior embodiment, wherein the compensator includes a bleed orifice.

Embodiment 15: A method for actuating a downhole tool including signaling the trigger in an actuator as claimed in claim 1, opening the atmospheric chamber of the actuator, causing a low pressure pulse in the actuator, and moving the device piston with the pulse.

Embodiment 16: The method as in any prior embodiment, further including routing the low pressure pulse to a reverse piston, moving the reverse piston with hydrostatic fluid pressure, and amplifying the pressure in a hydraulic fluid with the reverse piston above the pressure of the hydrostatic fluid pressure.

Embodiment 17: The method as in any prior embodiment, further including containing hydraulic actuation fluid in a loop sub that is connected to the prime mover arrangement.

Embodiment 18: The method as in any prior embodiment, further including receiving vent fluid from an actuated device in the loop sub.

Embodiment 19: A borehole system including a borehole in a subsurface formation, a string in the borehole, and the actuator as in any prior embodiment disposed within or as a part of the string.

Embodiment 20: The system as in any prior embodiment, wherein the actuator modular and is configured to attach to an outside surface of a number of downhole devices.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" includes a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An actuator comprising:

an impulse generation arrangement comprising:
- an atmospheric pressure chamber; and
- a valve connected fluidly to the chamber;

a prime mover arrangement comprising:
- a device piston; and
- a hydrostatic pressure source; and a hydraulic chamber disposed between and fluidically connecting the valve and the device piston, the valve, when open, connecting the hydraulic chamber to the atmospheric chamber.

2. The actuator as claimed in claim 1, wherein the hydraulic chamber directly connects the impulse generation arrangement with the prime mover arrangement.

3. The actuator as claimed in claim 1, wherein the hydraulic chamber exclusively connects the impulse generation arrangement with the prime mover arrangement.

4. The actuator as claimed in claim 1, wherein the hydraulic chamber is a control line.

5. The actuator as claimed in claim 1, wherein the actuator is a modular construction assemblable with a plurality of distinct and different tools.

6. The actuator as claimed in claim 5, further comprising a housing coupler configured to attach the actuator to a tool to be actuated.

7. The actuator as claimed in claim 6, wherein the impulse generation arrangement is disposed in a housing that is configured to attach to the housing coupler.

8. The actuator as claimed in claim 1, further including a reverse piston augmenter disposed between the hydrostatic pressure source and the device piston.

9. The actuator as claimed in claim 8, wherein the reverse piston augmenter includes a reverse piston having pressure areas that cause the reverse piston to increase the pressure of hydraulic fluid contacting the device piston above a pressure of the hydrostatic pressure acting on the reverse piston.

10. The actuator as claimed in claim 1, further including a hydraulic loop sub disposed between the hydrostatic pressure source and the device piston.

11. The actuator as claimed in claim 10, wherein the loop sub includes a hydraulic piston that includes piston areas causing hydraulic fluid pressure to be shuttled between lines.

12. The actuator as claimed in claim 10 wherein the hydraulic loop sub comprises a hydrostatic pressure inlet, a trigger outlet, a device fluid vent inlet and a device fluid outlet.

13. The actuator as claimed in claim 1, further including a compensator arrangement.

14. The actuator as claimed in claim 13, wherein the compensator includes a bleed orifice.

15. A method for actuating a downhole tool comprising:

signaling a trigger in an actuator as claimed in claim 1;

opening the atmospheric chamber of the actuator;

causing a low pressure pulse in the actuator; and moving the device piston with the pulse.

16. The method as claimed in claim 15, further comprising:

routing the low pressure pulse to a reverse piston;

moving the reverse piston with hydrostatic fluid pressure; and amplifying the pressure in a hydraulic fluid with the reverse piston above the pressure of the hydrostatic fluid pressure.

17. The method as claimed in claim 15, further comprising:

containing hydraulic actuation fluid in a loop sub that is connected to the prime mover arrangement.

18. The method as claimed in claim 17, further comprising:

receiving vent fluid from an actuated device in the loop sub.

19. A borehole system comprising:

a borehole in a subsurface formation;

a string in the borehole; and the actuator as claimed in claim 1 disposed within or as a part of the string.

20. The system as claimed in claim 19, wherein the actuator is modular and is configured to attach to an outside surface of a number of downhole devices.

21. An actuator comprising:

an impulse generation arrangement comprising:

an atmospheric pressure chamber; and a valve connected fluidly to the chamber;

a prime mover arrangement comprising:

a device piston;

a hydrostatic pressure source;

a reverse piston augmenter disposed between the hydrostatic pressure source and the device piston; and a hydraulic chamber disposed between and fluidically connecting the impulse generation arrangement and the prime mover arrangement.

22. An actuator comprising:

an impulse generation arrangement comprising:

an atmospheric pressure chamber; and a valve connected fluidly to the chamber;

a prime mover arrangement comprising:

a device piston;

a hydrostatic pressure source;

a hydraulic loop sub disposed between the hydrostatic pressure source and the device piston; and a hydraulic chamber disposed between and fluidically connecting the impulse generation arrangement and the prime mover arrangement.

23. The actuator as claimed in claim 1, wherein the device piston fluidically isolates the hydrostatic pressure source from the hydraulic chamber.

* * * * *